US010206051B2

(12) United States Patent
Boley

(10) Patent No.: US 10,206,051 B2
(45) Date of Patent: Feb. 12, 2019

(54) OCCLUSION CONTROL SYSTEM FOR A HEARING INSTRUMENT AND A HEARING INSTRUMENT

(71) Applicant: GN Hearing A/S, Ballerup (DK)

(72) Inventor: Jonathan Boley, Mundelein, IL (US)

(73) Assignee: GN Hearing A/S, Ballerup (DK)

( * ) Notice: Subject to any disclaimer, the term of this patent is extended or adjusted under 35 U.S.C. 154(b) by 44 days.

(21) Appl. No.: 15/618,996

(22) Filed: Jun. 9, 2017

(65) Prior Publication Data

US 2018/0359578 A1 Dec. 13, 2018

(51) Int. Cl.
*H04R 25/00* (2006.01)
*G10L 25/78* (2013.01)

(52) U.S. Cl.
CPC ..... *H04R 25/652* (2013.01); *G10L 25/78* (2013.01); *H04R 25/305* (2013.01); *H04R 25/505* (2013.01); *H04R 2225/025* (2013.01); *H04R 2225/41* (2013.01); *H04R 2460/09* (2013.01)

(58) Field of Classification Search
CPC .. H04R 25/652; H04R 25/305; H04R 25/505; H04R 2225/025; H04R 2225/41; H04R 2460/09; G10L 25/78
USPC ..... 381/328
See application file for complete search history.

(56) References Cited

U.S. PATENT DOCUMENTS 2,487,038 A * 11/1949 Baum ..... A61F 11/08 128/867
3,934,100 A * 1/1976 Harada ..... A61B 7/00 181/135
4,375,016 A * 2/1983 Harada ..... H04R 25/656 181/135
4,781,196 A * 11/1988 Killion ..... A61B 5/0408 600/379
6,724,902 B1 * 4/2004 Shennib ..... H04R 25/456 381/322
8,515,116 B2 * 8/2013 Lee ..... H04R 1/1041 381/338
8,873,791 B2 * 10/2014 Yang ..... H04R 1/1075 381/370
8,885,866 B2 * 11/2014 Sakaguchi ..... H04R 1/1058 381/380
9,118,995 B1 * 8/2015 Feeley ..... H04R 1/1016
9,807,524 B2 * 10/2017 Shennib ..... H04R 25/652
2012/0008808 A1 * 1/2012 Saltykov ..... H04R 25/48 381/317

(Continued)

FOREIGN PATENT DOCUMENTS

EP 2 405 674 A2 1/2012

*Primary Examiner* — Phylesha Dabney

(74) *Attorney, Agent, or Firm* — Vista IP Law Group, LLP

(57) ABSTRACT

An apparatus for a hearing instrument, the hearing instrument being configured to be at least partially placed in an ear canal of a wearer of the hearing instrument, the apparatus comprising: a sealing element configured to seal off the ear canal when the hearing instrument with the apparatus is at least partially positioned in the ear canal, wherein operation of the sealing element is controlled by an electric control signal, the sealing element being at least partially made from an electroactive material, wherein an acoustic impedance of the electroactive material of the sealing element varies as a function of an applied electric field, the applied electric field being based on a characteristic of the electric control signal.

19 Claims, 3 Drawing Sheets

(56) References Cited

U.S. PATENT DOCUMENTS

2013/0343594 A1* 12/2013 Howes ..... H04R 1/1016
381/380

* cited by examiner

OCCLUSION CONTROL SYSTEM FOR A HEARING INSTRUMENT AND A HEARING INSTRUMENT

TECHNICAL FIELD

The disclosure primarily relates to an occlusion control system for a hearing instrument and a hearing instrument being provided with such a system.

BACKGROUND

Many different kinds of ear-worn devices are known in the art. For the purposes of this application, traditional hearing aids, tinnitus maskers, hearables, non-prescription hearing aids, earbuds, hearing protections and others are all encompassed by the employed omnibus term hearing instrument.

Traditional hearing aids are representative for synoptically illustrating structure and function of the entire class of hearing instruments. In this context, several different types of hearing aids are known. Miniature hearing aids that are completely wearable in the ear, e.g. in-the-ear hearing aid (ITE) or completely-in-the-canal hearing aid (CIC), are suitable for countering mild hearing impairment. In order to counter more severe hearing impairment larger devices, worn behind the ear, e.g. behind-the-ear hearing aid (BTE) or receiver-in-the-canal hearing aid (RIE), are normally required. These devices deliver audio data, either as an acoustic wave or as a wired electric signal, to a bell-shaped hearing aid dome that is positioned in the ear of the hearing-impaired person.

Regardless of the type of hearing instrument employed, the ear canal becomes at least partially occluded from the outside environment when the hearing instrument is in use. As a consequence, occlusion effect develops. It is manifested by the hearing instrument wearer perceiving his/her own voice as being hollow and/or becoming unnaturally amplified.

Traditionally, the above-discussed undesirable effects are reduced by introducing a ventilation tube (vent) that establishes fluid communication between the ear canal cavity and the outside environment. As is well-known to the artisan, this solution is still ridden with considerable drawbacks. In an attempt to remedy these, EP2405674 discloses a vent with a resonator. Its resonance frequency range is rather narrow (10-100 Hz) and permanently preset at the factory.

In consequence, some problems associated with the solutions available in the art still persist. This is particularly true in complex and/or fast-changing listening situations.

SUMMARY

One objective at hand is to at least alleviate drawbacks associated with the current art.

The above stated objective is mainly achieved by means of an occlusion control system for a hearing aid according to the independent claim, and by the embodiments according to the dependent claims.

More specifically, the present disclosure provides an occlusion control system for a hearing instrument, the system being adapted for positioning in an ear canal of a wearer of the hearing instrument. Said system comprises a sealing element that physically seals off the ear canal when said system is positioned in the ear canal. The operation of the sealing element is controlled by an electric control signal, said sealing element being at least partially made in an electroactive material. Acoustic impedance of the electroactive material varies as a function of an applied electric field determined by the content of the electric control signal.

In the following, positive effects and advantages of one or more embodiments are presented.

What is achieved is a way of dynamically adjusting acoustic properties of the sealing element that at all times physically seals off the ear canal cavity. Acoustic properties are adjusted across the entire hearing frequency band. This is achieved by applying an electric field on the electroactive material that makes up the sealing element. The applied force entails change of the compliance of the electroactive material, i.e. its elastic properties are changed. As an example, the electroactive material, when subjected to an applied force, may go from being soft to becoming completely rigid. The electroactive material in rigid state is acoustically occluded, i.e. sound waves cannot pass across, whereas the same material in soft state is acoustically non-occluded and allows passage of sound waves. In consequence, by changing the compliance of the electroactive material, acoustic impedance of the sealing element, i.e. its resistance to the acoustic flow in the shape of the sound waves, is altered. Accordingly and depending on the compliance of the electroactive material of the sealing element, different amounts of sound energy may pass across the barrier represented by the sealing element. Compliance of the electroactive material of the sealing element could be controlled by the signal processor configured to generate an electric control signal. The content of the electric control signal, hence the elastic properties of the electroactive material, corresponds to the requirements posed by the wearer's outside environment, e.g. noisy, quiet, music concert, and/or wearer's state, e.g. speaking, eating, walking. In conclusion, active control of the sound waves propagating towards or away from the ear canal cavity may be obtained so as to achieve maximal functional sealing of the ear canal with minimal occlusion effect.

Here, the outside environment is to be construed as including all sounds which come from the outside to the hearing instrument. By way of example, one characterizing feature of such an acoustic environment is the spectral distribution of the energy of the environmental noise.

When the membrane is soft, low-frequency sound waves are transmitted through. The low frequency energy inside the ear canal is therefore controlled by adjusting the acoustic impedance of the membrane—a rigid membrane provides greater acoustic impedance and increases the low-frequency energy in the ear, whereas a soft/flexible membrane provides less acoustic impedance and decreases the low-frequency energy (by allowing the energy to dissipate). Since a flexible membrane allows low-frequency energy to dissipate, the occlusion effect can be minimized. In this way, the user's voice (as well as chewing sounds, footsteps, etc.) is not amplified at low frequencies. In the same context, the wearer can benefit from improved bass response for music listening or even for sound signal amplification in order to account for low-frequency hearing loss.

At the same time, a membrane in rigid state prevents environmental noise from leaking into the ear canal, thus providing signal processing opportunities to improve the signal-to-noise ratio (e.g., noise reduction, beamforming, etc.).

An apparatus for a hearing instrument, the hearing instrument being configured to be at least partially placed in an ear canal of a wearer of the hearing instrument, the apparatus comprising: a sealing element configured to seal off the ear canal when the hearing instrument with the apparatus is at least partially positioned in the ear canal, wherein operation of the sealing element is controlled by an electric control signal, the sealing element being at least partially made from an electroactive material, wherein an acoustic impedance of the electroactive material of the sealing element varies as a function of an applied electric field, the applied electric field being based on a characteristic of the electric control signal.

Optionally, the electroactive material comprises an elastomer.

Optionally, the electroactive material is shaped as a membrane.

Optionally, the apparatus further includes a polymer layer that at least partially overlaps with the membrane-shaped electroactive material.

Optionally, the polymer layer is made of silicone.

Optionally, the polymer layer is arranged to face the ear canal when the hearing instrument is at least partially positioned in the ear canal.

Optionally, at least one of the membrane-shaped electroactive material and the polymer layer has at least one perforation.

Optionally, a total acoustic mass of the at least one perforation exceeds 5000 $kg/m^4$.

Optionally, the electroactive material comprises carbon nanotubes.

Optionally, a voltage of the applied electric field is anywhere from 0 V to 1.5 V.

Optionally, the electroactive material in a first state has a first acoustic impedance and in a second state has a second acoustic impedance, the first acoustic impedance being higher than the second acoustic impedance.

Optionally, the electric control signal for controlling operation of the sealing element to adjust the acoustic impedance of the electroactive material is based on a first electrical signal comprising information on external sounds.

Optionally, the electric control signal for controlling operation of the sealing element to adjust the acoustic impedance of the electroactive material is based on the second electric signal comprising information on sounds generated in a sealed off portion of the ear canal.

Optionally, the apparatus further includes a detector configured to detect whether the wearer of the hearing instrument is speaking, wherein the detector is configured to output a detector electric signal in response to a detected speech, and wherein the electric control signal for controlling operation of the sealing element to adjust the acoustic impedance of the electroactive material is based on the detector electric signal.

A hearing instrument includes the apparatus.

Optionally, the hearing instrument includes a signal processor configured to provide the electric control signal.

Optionally, the hearing instrument includes an earpiece, wherein the sealing element is a part of the earpiece.

Optionally, the earpiece comprises one or more apertures, and the sealing element covers the one or more apertures.

Optionally, the apparatus further includes a signal processor configured to provide the electric control signal.

Further advantages and features of embodiments will become apparent when reading the following detailed description in conjunction with the drawings.

DETAILED DESCRIPTION OF THE EMBODIMENTS

Figure 2:
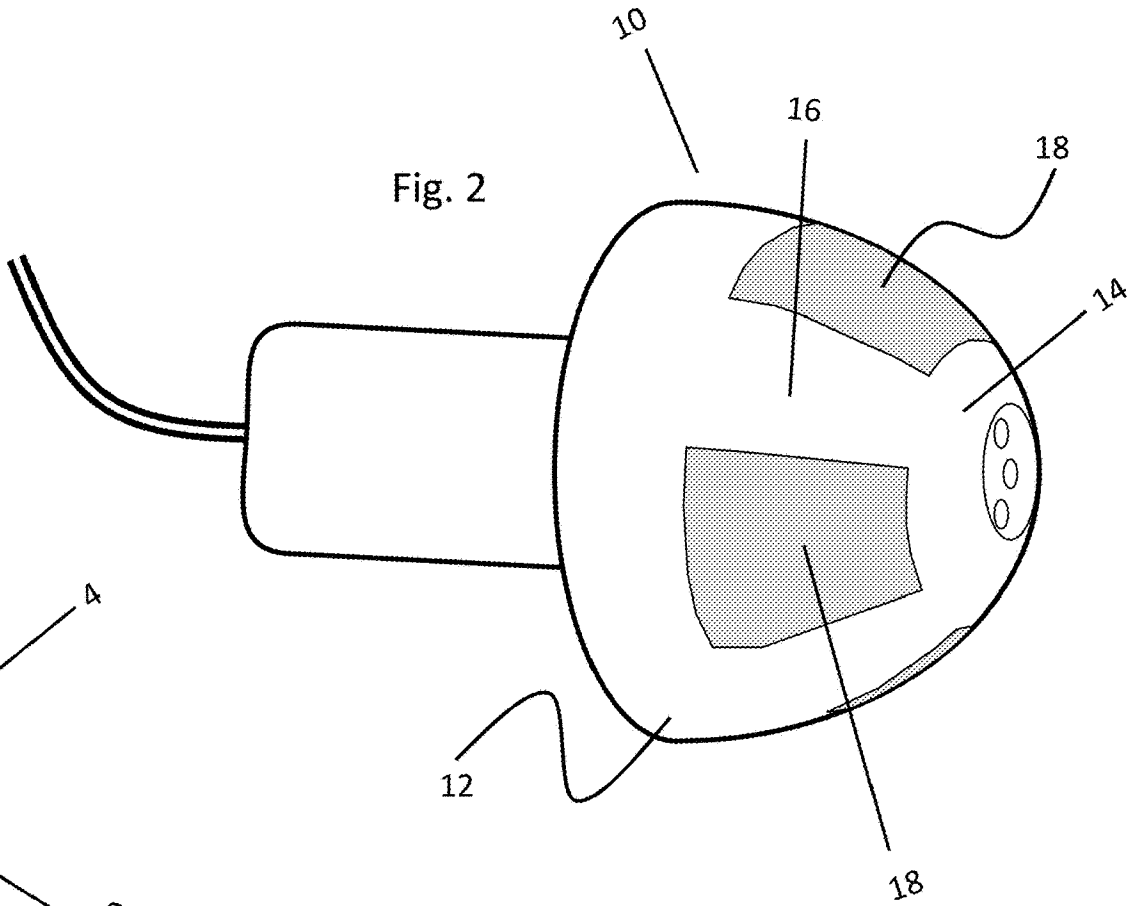
FIG. 2 is a close-up of the embodiment of the occlusion control system shown in FIG. 1.

The embodiments will now be described more fully hereinafter with reference to the accompanying drawings. The claimed invention may, however, be embodied in many different forms and should not be construed as limited to the embodiments set forth herein. In the drawings, like reference signs refer to like elements.

Figure 1:
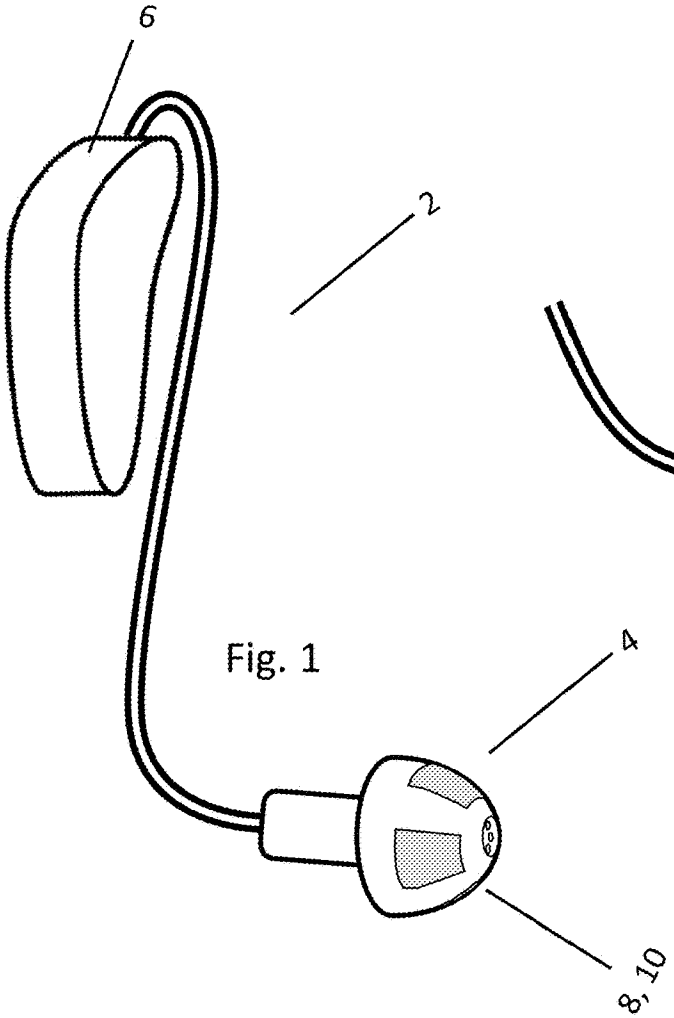
FIG. 1 is a perspective view of a hearing aid of the BTE-type comprising the occlusion control system according to one embodiment.

FIG. 1 is a perspective view of a hearing aid 2 of the BTE-type comprising an occlusion control system 4 according to one embodiment.

The BTE-device has a main body 6, including most of the components and being placed behind the ear when the hearing aid is in use, and an earpiece 8 for insertion into the ear canal of the wearer. Accordingly, the ear piece of BTE-devices, comprising a dome structure 10, is separated from the main body of the hearing aid and it fits snugly into the wearer's ear canal. In this embodiment, the occlusion control system is a part of the dome structure. This embodiment will be discussed in more detail in connection with FIG. 2.

FIG. 2 is a close-up of the occlusion control system 4 shown in FIG. 1. Here, the occlusion control system is part of a dome structure 10. The dome structure comprises a dome base 12 and a dome top 14. These are physically connected by means of curved, peripherally extending ribs 16. Apertures in the dome structure are covered by a sealing element 18 of the occlusion control system. Hereby, the ear canal is physically sealed off when the system is positioned in the ear canal. The sealing element comprises an electroactive material. As it may be seen, the electroactive material is shaped as a membrane. In a preferred embodiment, the electroactive material is a polymer, more precisely an elastomer. Alternatively (not shown), the peripheral ribs may be dispensed with such that the electroactive material extends between the dome base and the dome top along entire periphery of the dome structure. Operation of the sealing element is controlled by an electric control signal. The electric control signal is normally generated by a signal processor, typically housed in the main part shown in FIG. 1. Operation of the sealing element implies that the acoustic impedance of the electroactive material varies as a function of an applied electric field. In some embodiments, circuitry and/or module in the signal processor that generates the electric control signal may be considered to be a part of the occlusion control system 4. In other embodiments, the circuitry and/or module in the signal processor that generates the electric control signal may be considered as not a part of the occlusion control system 4.

Hereby, acoustic properties of the sealing element that at all times physically seals off the ear canal cavity may be dynamically adjusted. This is achieved by applying an electric field on the electroactive material that makes up the sealing element. Magnitude of the applied field is determined by the content of the electric control signal, typically including control data in accordance with a predefined criterion or a suitable algorithm. The applied force entails change of the compliance of the electroactive material, i.e. its elastic properties are changed. As an example, the electroactive material, when subjected to an applied force, may go from being soft, i.e. having low acoustic impedance, to becoming completely rigid, i.e. having high acoustic impedance. The electroactive material in rigid state is acoustically occluded, i.e. sound waves cannot pass across, whereas the same material in soft state is acoustically non-occluded and allows passage of sound waves. In consequence, by changing the compliance of the electroactive material, acoustic impedance of the sealing element, i.e. its resistance to the acoustic flow in the shape of the sound waves, is altered. Accordingly and depending on the compliance of the electroactive material of the sealing element, different amounts of sound energy may pass across the barrier represented by the sealing element. Compliance of the electroactive material of the sealing element could be controlled by the signal processor configured to generate an electric control signal.

As mentioned above, the above-described system is also suitable for integration in RIE-devices, i.e. devices where the receiver/speaker unit is part of the dome structure. It is equally conceivable to integrate the system in a double-dome structure.

The system may further comprise a silicone-made polymer layer (not shown) arranged so as to at least partially overlap with the membrane-shaped electroactive material. Preferably, the polymer layer is arranged so as to face the ear canal, i.e. it covers the electroactive polymer, when the system is positioned in the ear canal.

In one embodiment (not shown), at least one of the membrane-shaped electroactive material and the polymer layer is provided with at least one perforation that confers a venting effect. Regardless the number of perforations made, the total acoustic mass preferably exceeds 5000 $kg/m^4$.

In a further embodiment, the electroactive material comprises carbon nanotubes. In that case, the voltage of the applied electric field could be in the range between 0 V and 1.5 V, i.e. rather low voltages are required to ensure satisfactory operation of the system.

Figures 3, 5:
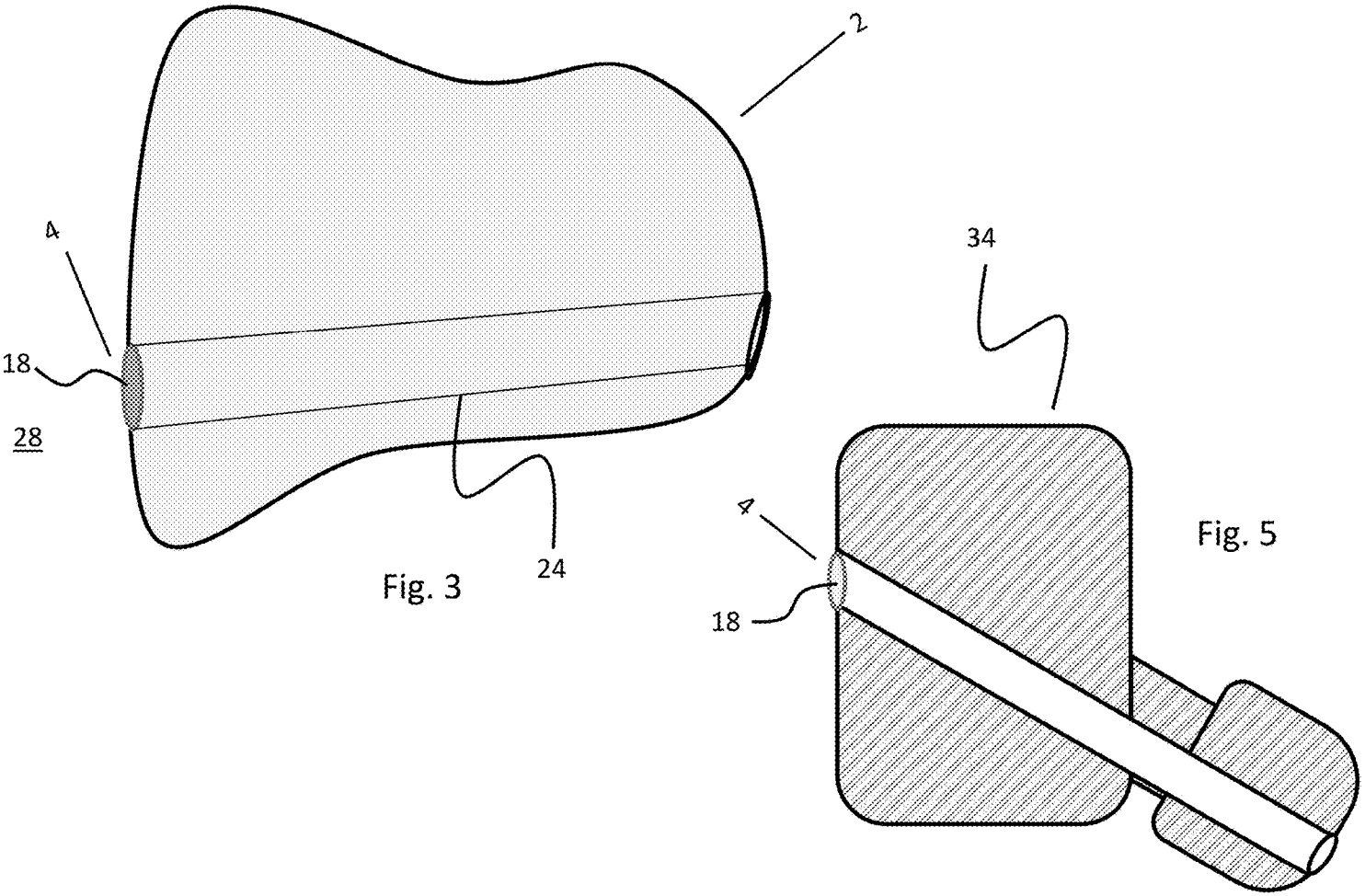
FIG. 3 is a perspective view of a hearing aid 2 of the ITE-type comprising the occlusion control system 4 according to another embodiment.
FIG. 5 is a perspective view of a hearing protection device comprising the occlusion control system according to one embodiment.

FIG. 3 is a perspective view of a hearing aid 2 of the ITE-type comprising an occlusion control system 4 according to another embodiment. As it may be seen, the occlusion control system is integrated in a hearing instrument that can be fully contained within the ear. It should be noted that the occlusion control system 4 is not limited to application for ITE-devices (in-the-ear) or BTE devices. For examples, in other embodiments, the occlusion control system 4 may be employed for CIC-devices (completely-in-the-canal), or other types of hearing instrument. A sealing element 18 of the shown occlusion control system is a planar structure arranged at an inlet portion of a vent tube 24 traversing the hearing instrument and connecting an ear canal cavity 26 and the outside environment 28. Typically, the electroactive material is suspended onto a circumferentially extending support structure (not visible), the shape of which is congruent with the cross-sectional shape of the vent tube. Further properties and operation of the sealing element are commensurate with those discussed in connection with FIG. 2.

Figure 4:
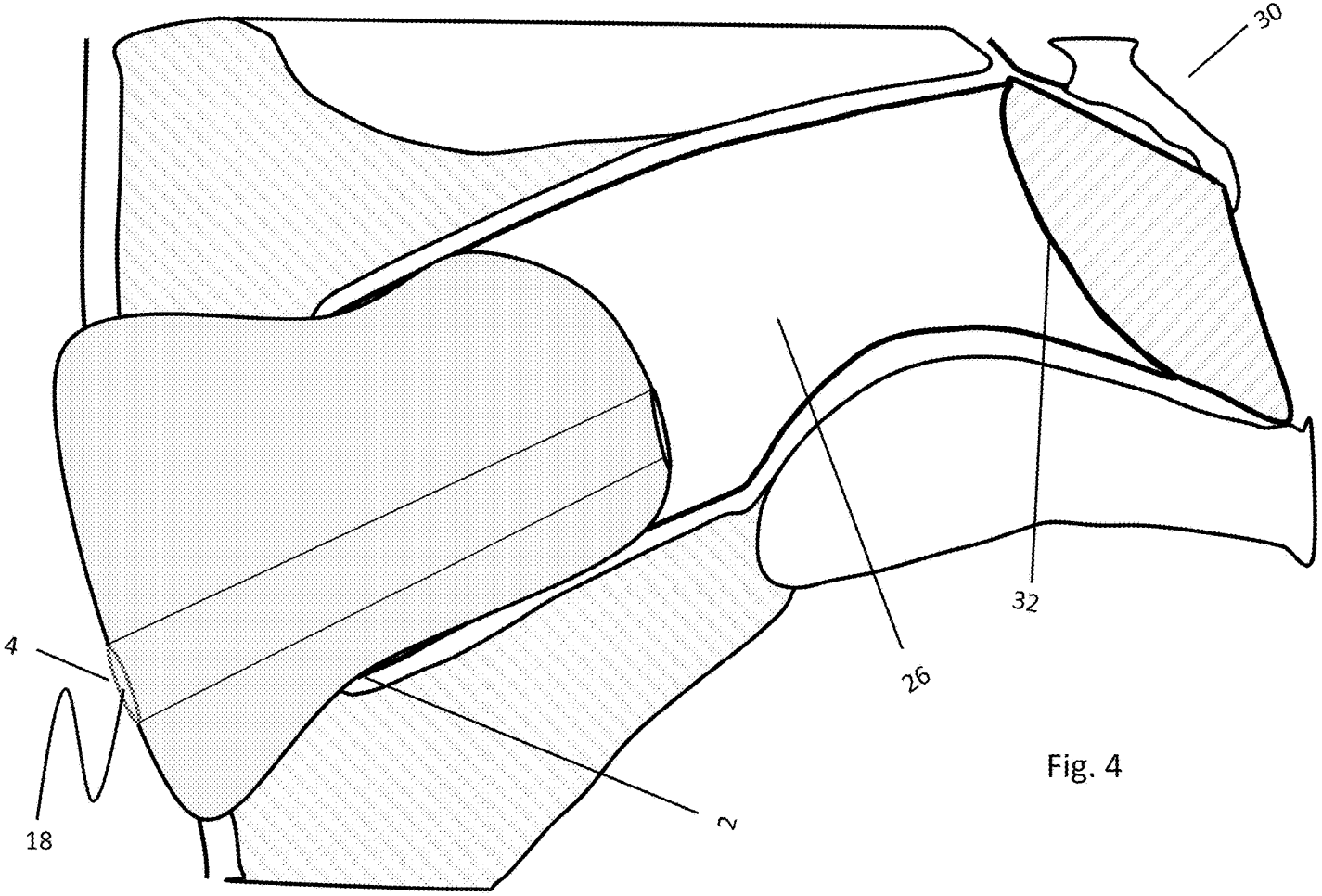
FIG. 4 is a contextual view of the hearing aid of the ITE-type shown in FIG. 3, when said hearing aid is inserted in the ear of the wearer.

FIG. 4 is a contextual view of the hearing aid 2 of the ITE-type shown in FIG. 3, when said hearing aid is inserted in the ear 30 of the wearer. A residual volume/cavity 26 in the ear canal, delimited by the hearing aid, ear tissue and the ear drum 32 may be seen. With respect to the operation of the sealing element 18 of the occlusion control system 4 and in addition to what has been said in connection with FIG. 2, a dynamic, time-variant control of acoustically closing or opening the sealing element 18, i.e. changing its state, can be provided as required by the acoustic situation at hand. Overall, this results in an improved hearing comfort for the wearer. A few, non-limiting examples of this situation-dependency are listed below:

acoustically opening the sealing element (creating low acoustic impedance) in connection with the presence of own voice;

acoustically closing the sealing element (creating high acoustic impedance) when subject to low-frequency music;

acoustically opening the sealing element (creating low acoustic impedance) in a quiet environment;

In one non-limiting embodiment (not shown), the occlusion control system may comprise a microphone arranged to pick up external sounds and to output a first electric signal, wherein the signal processor uses the first electric signal when generating the electric control signal for controlling operation of the sealing element so as to adjust acoustic impedance of the electroactive material. The microphone could be a part of the occlusion control system, but any of the microphones of the hearing aids could also be used.

In another not shown, non-limiting embodiment, the occlusion control system further comprises a microphone arranged to pick up sounds generated in the physically sealed off portion of the ear canal, i.e. the microphone faces the ear canal cavity. In response to sound pick-up, the microphone outputs a second electric signal, wherein the signal processor uses the second electric signal when generating the electric control signal for controlling operation of the sealing element so as to adjust acoustic impedance of the electroactive material. Again, the microphone could be a part of the occlusion control system, but a microphone belonging to the hearing aid could also be used.

In a related embodiment, the system could have a pair of microphones, one for picking up external sounds and another for picking up sounds generated in the cavity. This could further improve steering of the electroactive material and minimize occlusion effect, even in very complex acoustic situations.

In another related embodiment, a vibration sensor can be used for picking up sounds generated in the cavity. This could further improve steering of the electroactive material and minimize occlusion effect, even in very noisy acoustic environments.

In yet another embodiment, the occlusion control system or the hearing aid itself may further comprise a detector for detecting whether a wearer of the hearing aid is speaking and said detector, in response to detected speech, is configured to output a detector electric signal, wherein the signal processor uses the detector electric signal when generating the electric control signal for controlling operation of the sealing element so as to adjust acoustic impedance of the electroactive material. In its basic implementation, the sealing element would, in response to detected speech attributable to the wearer, become maximally acoustically transparent (state of minimum acoustic impedance) in order to maximally attenuate detrimental occlusion effects.

FIG. 5 is a perspective view of a hearing protection device 34 comprising an occlusion control system 4 with a sealing element 18 according to one embodiment. As clearly seen, the occlusion control system, when incorporated in a hearing protection device, carries significant structural resemblance to the solution deployed for a hearing aid of the ITE-type (shown in FIGS. 3 and 4). In addition, its functional properties are substantially identical to those of said ITE-device.

In the drawings and specification, there have been disclosed typical preferred embodiments and, although specific terms are employed, they are used in a generic and descriptive sense only and not for purposes of limitation, the scope of the claimed invention being set forth in the following claims.

The invention claimed is:

1. An apparatus for a hearing instrument, the hearing instrument being configured to be at least partially placed in an ear canal of a wearer of the hearing instrument, the apparatus comprising:

a sealing element configured to seal off the ear canal when the hearing instrument with the apparatus is at least partially positioned in the ear canal, wherein operation of the sealing element is controlled by an electric control signal, the sealing element being at least partially made from an electroactive material, wherein an acoustic impedance of the electroactive material of the sealing element varies as a function of an applied electric field, the applied electric field being based on a characteristic of the electric control signal.

2. The apparatus according to claim 1, wherein the electroactive material comprises an elastomer.

3. The apparatus according to claim 1, wherein the electroactive material is shaped as a membrane.

4. The apparatus according to claim 3, further comprising a polymer layer that at least partially overlaps with the membrane-shaped electroactive material.

5. The apparatus according to claim 4, wherein the polymer layer is made of silicone.

6. The apparatus according to claim 4, wherein the polymer layer is arranged to face the ear canal when the hearing instrument is at least partially positioned in the ear canal.

7. The apparatus according to claim 4, wherein at least one of the membrane-shaped electroactive material and the polymer layer has at least one perforation.

8. The apparatus according to claim 7, wherein a total acoustic mass of the at least one perforation exceeds 5000 $kg/m^4$.

9. The apparatus according to claim 1, wherein the electroactive material comprises carbon nanotubes.

10. The apparatus according to claim 9, wherein a voltage of the applied electric field is anywhere from 0 V to 1.5 V.

11. The apparatus according to claim 1, wherein the electroactive material in a first state has a first acoustic impedance and in a second state has a second acoustic impedance, the first acoustic impedance being higher than the second acoustic impedance.

12. The apparatus according to claim 1, wherein the electric control signal for controlling operation of the sealing element to adjust the acoustic impedance of the electroactive material is based on a first electrical signal comprising information on external sounds.

13. The apparatus according to claim 1, wherein the electric control signal for controlling operation of the sealing element to adjust the acoustic impedance of the electroactive material is based on the second electric signal comprising information on sounds generated in a sealed off portion of the ear canal.

14. The apparatus according to claim 1, further comprising a detector configured to detect whether the wearer of the hearing instrument is speaking, wherein the detector is configured to output a detector electric signal in response to a detected speech, and wherein the electric control signal for controlling operation of the sealing element to adjust the acoustic impedance of the electroactive material is based on the detector electric signal.

15. A hearing instrument comprising the apparatus according to claim 1.

16. The hearing instrument according to claim 15, further comprising a signal processor configured to provide the electric control signal.

17. The hearing instrument according to claim 15, comprising an earpiece, wherein the sealing element is a part of the earpiece.

18. The hearing instrument according to claim 17, wherein the earpiece comprises one or more apertures, and the sealing element covers the one or more apertures.

19. The apparatus according to claim 1, further comprising a signal processor configured to provide the electric control signal.

* * * * *